US011946195B1

(12) United States Patent
Petrie

(10) Patent No.: US 11,946,195 B1
(45) Date of Patent: Apr. 2, 2024

(54) PROGRAMMABLE AUTOMATED CLOTHES WASHER, TRANSFER, AND DRYER SYSTEM

(71) Applicant: Russell Glenn Petrie, Littleton, CO (US)

(72) Inventor: Russell Glenn Petrie, Littleton, CO (US)

( * ) Notice: Subject to any disclaimer, the term of this patent is extended or adjusted under 35 U.S.C. 154(b) by 0 days.

(21) Appl. No.: 17/974,366

(22) Filed: Oct. 26, 2022

Related U.S. Application Data

(60) Provisional application No. 63/272,072, filed on Oct. 26, 2021.

(51) Int. Cl.

| | |
|---|---|
| ***D06F 95/00*** | (2006.01) |
| ***D06F 23/04*** | (2006.01) |
| ***D06F 33/32*** | (2020.01) |
| ***D06F 37/12*** | (2006.01) |
| ***D06F 39/12*** | (2006.01) |
| ***D06F 58/04*** | (2006.01) |
| ***D06F 58/20*** | (2006.01) |

(52) U.S. Cl.
CPC ..... *D06F 95/00* (2013.01); *D06F 23/04* (2013.01); *D06F 33/32* (2020.02); *D06F 37/12* (2013.01); *D06F 39/12* (2013.01); *D06F 58/04* (2013.01); *D06F 58/20* (2013.01)

(58) Field of Classification Search
CPC ..... D06F 95/00; D06F 23/04; D06F 33/32; D06F 37/12; D06F 39/12; D06F 58/04; D06F 58/20; D06F 31/00; D06F 29/00
USPC ..... 68/13 R
See application file for complete search history.

(56) References Cited

U.S. PATENT DOCUMENTS

| | | | | |
|---|---|---|---|---|
| 2,816,429 | A * | 12/1957 | Kurlancheek | D06F 29/005 68/152 |
| 4,207,638 | A * | 6/1980 | Biesinger | D06F 95/00 68/210 |
| 4,285,219 | A * | 8/1981 | Grunewald | D06F 95/00 68/210 |
| 6,671,978 | B1 * | 1/2004 | McGowan | D06F 95/00 68/19.2 |
| 7,404,303 | B1 * | 7/2008 | Barbosa | D06F 37/04 68/3 R |
| 10,458,054 | B1 * | 10/2019 | Hamilton | D06F 31/00 |
| 2007/0169519 | A1 * | 7/2007 | Hershey | D06F 95/00 68/19 |
| 2014/0318191 | A1 * | 10/2014 | Lorick | D06F 29/005 68/19 |
| 2015/0135778 | A1 * | 5/2015 | Ham | D06F 17/08 68/133 |
| 2018/0291545 | A1 * | 10/2018 | Jones | D06F 34/05 |
| 2020/0370221 | A1 * | 11/2020 | Jones | D06F 29/005 |
| 2022/0127771 | A1 * | 4/2022 | Allen | D06F 29/005 |

* cited by examiner

*Primary Examiner* — David G Cormier
*Assistant Examiner* — Thomas Bucci
(74) *Attorney, Agent, or Firm* — Plager Schack LLP; Mark H. Plager; Stephen Hallberg

(57) ABSTRACT

A programmable automated clothes washer, transfer, and dryer system is disclosed. The programmable automated clothes washer, transfer, and dryer system allows a person doing laundry to program in a load of laundry to be washed. The programmable automated clothes washer, transfer, and dryer system goes through the wash cycle, spins the clothes, and then transfers the clothes from the washer internally to the dryer, then the dryer starts after the transfer and dries them.

7 Claims, 8 Drawing Sheets

PROGRAMMABLE AUTOMATED CLOTHES WASHER, TRANSFER, AND DRYER SYSTEM

CLAIM OF BENEFIT TO PRIOR APPLICATION

This application claims benefit to U.S. Provisional Patent Application 63/272,072, entitled "Automated home clothes washing and drying system," filed Oct. 26, 2021. The U.S. Provisional Patent Application 63/272,072 is incorporated herein by reference.

BACKGROUND

Embodiments of the invention described in this specification relate generally to cleaners, and more particularly, to a programmable automated clothes washer, transfer, and dryer system.

Home washers and driers currently require a lot of human interaction. Specifically, a person who wants to do laundry has to put clothes in the washer, run the washer to clean the clothes, pull the wet clothes out of the washer, transfer the wet clothes from the washer and put them in the dryer, and then run the dryer to complete the cycle for this single load of laundry. Normally, these steps also include other, related steps, such as opening the washer door, taking out the wet clothes, then opening the dryer door, adding the wet clothes to the dryer, and closing the dryer door and starting the dryer.

This can be a strenuous process for a person to complete, as these steps may involve a lot of bending over, reaching, pulling, lifting (wet clothes tend to be heavy), and moving around/positioning of the clothes, among other things. Furthermore, the available space for movement by the individual may be limited, and may cause the person to stand or position themselves awkwardly, leading to more physical strain for the individual (e.g., muscular effort to lift and transfer wet clothes), repeated bending, or otherwise exposing the body of body parts to injury via bumping, overextending, unusual stances, etc. This also leads to more mental strain associated with the task(s) at hand.

Therefore, what is needed is a way to redesign a top washer and a dryer into a combined clothes washing and drying system that can automate clothes washing, transfer of washed clothes to dryer, and drying of the washed clothes after transfer.

BRIEF DESCRIPTION

A novel programmable automated clothes washer, transfer, and dryer system is disclosed. In some embodiments, the programmable automated clothes washer, transfer, and dryer system automates clothes washing and drying according to laundry cycle programming set or selected by a person (or "user") for each load of laundry to be washed and dried. Based on the laundry cycle programming set or selected by the user, the programmable automated clothes washer, transfer, and dryer system goes through the wash cycle, then automatically and internally transfers the washed clothes from the washer to the dryer through a clothes transfer apparatus, and, after the clothes are transferred into the dryer, starts the dryer to dry the clothes.

In some embodiments, the wash cycle comprises a clothes washing cycle, a rinse cycle, and a spin cycle. In some embodiments, the user can (i) select from several wash cycle programs with pre-programmed settings for the clothes washing cycle, the rinse cycle, and the spin cycle, or (ii) individually program the settings for the clothes washing cycle, the rinse cycle, and the spin cycle.

In some embodiments, the programmable automated clothes washer, transfer, and dryer system comprises a programmable automated clothes washing machine, a programmable automated dryer, and a clothes transfer apparatus fabricated to form a clothes transfer path connected between the washing machine and the dryer. In some embodiments, the programmable automated clothes washer, transfer, and dryer system further comprises an automated upper cabinet. In some embodiments, the programmable automated clothes washing machine comprises a washer control unit that runs wash cycle programs specified or selected by an operator. In some embodiments, the programmable automated dryer comprises a dryer control unit that runs dryer cycle programs specified or selected by the operator. In some embodiments, the automated upper cabinet comprises a cabinet control unit that releases loads of laundry when directed.

In some embodiments, the programmable automated clothes washer, transfer, and dryer system further comprises a main system control unit with an embedded system processing unit. In some embodiments, the main system control unit is configured to coordinate and manage a laundry cycle program (set or selected by the user) that incorporates and synchronizes one or more of a wash cycle program, cabinet laundry load setting, and a dry cycle program in connection with the washer control unit, the cabinet control unit, and the dryer control unit, respectively for each load of laundry to be washed and dried.

In some embodiments, the processing unit comprises a computing device with a processor, an internal storage, a memory module, and a wireless communication module. In some embodiments, the wireless communication module comprises a WiFi antenna. In some embodiments, the wireless communication module comprises a nearby wireless communication device, such as a Bluetooth transceiver. In some embodiments, a mobile application is configured to wirelessly communicate with the programmable automated clothes washer, transfer, and dryer system through the wireless communication module. In some embodiments, an operator (or user) with a mobile device on which the mobile application is installed can remotely interact with and program the programmable automated clothes washer, transfer, and dryer system to start and complete one or more loads of laundry.

In some embodiments, the programmable automated clothes washing machine comprises a washer drum, a lifting screw, and a clothes transfer outlet that leads to the clothes transfer apparatus. In some embodiments, the programmable automated clothes washing machine further comprises a pressure tank door. In some embodiments, the programmable automated clothes washing machine further comprises a liquid detergent compartment, a liquid bleach compartment, and a liquid fabric softener compartment. In some embodiments, the programmable automated clothes washing machine is a top loading washer comprising a washer lid.

In some embodiments, the programmable automated dryer comprises a dryer drum, a catch tray, expandable dryer fins, and a one-way spring loaded valve that provides a clothes inlet from the clothes transfer apparatus. In some embodiments, the programmable automated dryer further comprises a dryer door.

In some embodiments, the clothes transfer apparatus has a downward slope along the clothes transfer path starting, at a high point, from the washing machine down to the dryer. In some embodiments, the clothes transfer apparatus comprises ball bearings that are exposed along an inner surface of the clothes transfer apparatus. In some embodiments, the downward slope and the ball bearings enhance the ability of the clothes to be transferred successfully into the dryer.

In some embodiments, the programmable automated clothes washer, transfer, and dryer system further comprises an automated laundry cabinet (also referred to as the "upper cabinet") that is positioned above a top loading programmable automated clothes washing machine and configured to hold several loads of laundry in several laundry pre-load cabinet shelves with automatic cabinet shelf doors that flap open to release each load of laundry into the washing machine according to laundry cycle programs set or selected by the user.

In some embodiments, the programmable automated clothes washer, transfer, and dryer system allows a user to pre-load and program laundry cycle programs for a series of standard loads of laundry. In some embodiments, the laundry pre-load cabinet is programmed with the washer and dryer system so that the processing unit carries out the laundry cycle programs with actions directed to the laundry pre-load cabinet. In some embodiments, the user programs a standard load of laundry to wash in the washing machine by selecting a wash time, a detergent and amount of detergent to use, and a softener and amount of softener to use. In some embodiments, the user programs a standard load of laundry to dry in the dryer by selecting a dry time, a dryer heat level, and a drying spin cycle. When the start button of the washer is pushed (or when the current time of day is the same as the start time set by the user in the programmed parameter settings), the lid on the washer opens (by an automated crank) and the first load of laundry drops into the washer. The washer goes through its wash and spin cycles, adding detergents, bleach, and/or fabric softener as programmed. When the washer is completed, the washer automatically transfers the clothes to the dryer via the transfer path. At the end of the dry cycle, the dryer door opens and the clothes are spun out of the dryer into a catch tray.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
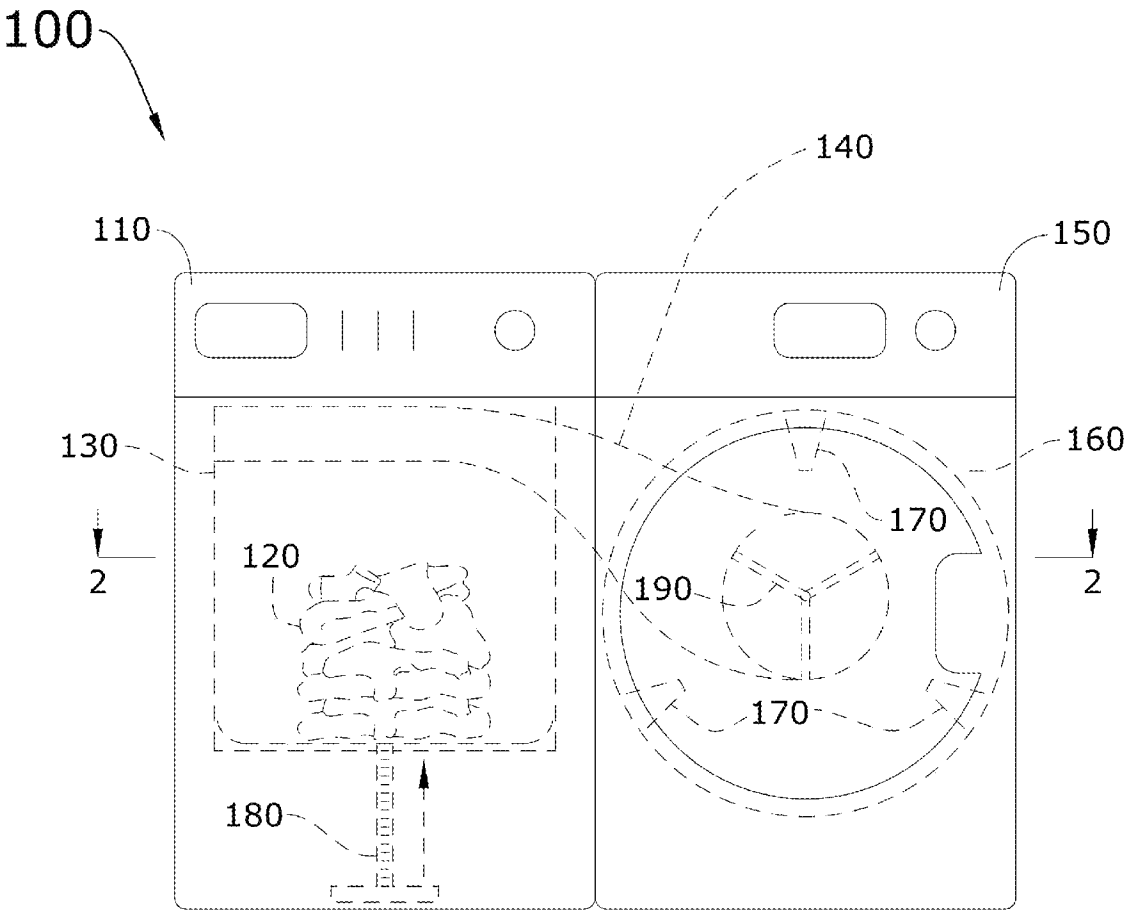
FIG. 1 conceptually illustrates a programmable automated clothes washer, transfer, and dryer system in some embodiments.

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel programmable automated clothes washer, transfer, and dryer system. In some embodiments, the programmable automated clothes washer, transfer, and dryer system allows a user to pre-load and program up to standard loads of laundry. The programmable automated clothes washer, transfer, and dryer system allows the person doing laundry to program in a load of laundry to be washed. Then the programmable automated clothes washer, transfer, and dryer system goes through the wash cycle, spins the clothes inside, and then automatically transfers the clothes from the washer internally to the dryer. The dryer then starts after the transfer and dries them.

As stated above, home washers and driers currently require a lot of human interaction. Specifically, a person who wants to do laundry has to put clothes in the washer, run the washer to clean the clothes, pull the wet clothes out of the washer, transfer the wet clothes from the washer and put them in the dryer, and then run the dryer to complete the cycle for this single load of laundry. Normally, these steps also include other, related steps, such as opening the washer door, taking out the wet clothes, then opening the dryer door, adding the wet clothes to the dryer, and closing the dryer door and starting the dryer. This is often strenuous work for a person, and typically involve a lot of bending over, reaching, pulling, lifting (wet clothes tend to be heavy), and moving around/positioning of the clothes, among other things. Furthermore, the available space for movement by the individual may be limited, and may cause the person to stand or position themselves awkwardly, leading to more physical strain for the individual (e.g., muscular effort to lift and transfer wet clothes), repeated bending, or otherwise exposing the body of body parts to injury via bumping, over-extending, unusual stances, etc. This also leads to more mental strain associated with the task(s) at hand. Embodiments of the programmable automated clothes washer, transfer, and dryer system described in this specification solve such problems by providing an automated way to start and run washing of laundry, automatically transfer clean washed clothes into a dryer, and automatically run a drying cycle to dryer the laundry, and by providing the ability to automate the washing/drying for multiple consecutive loads of laundry.

Embodiments of the programmable automated clothes washer, transfer, and dryer system described in this specification differ from and improve upon currently existing options. In particular, some embodiments differ from the existing washing machines and dryers in the market by providing a transfer mechanism that is configured to automatically transfer wet clothes from one machine (the washing machine) to the other machine (the dryer) without human involvement in the transfer of clothes. Furthermore, the programmable automated clothes washer, transfer, and dryer system described in this disclosure allows the person doing laundry to program in a load (or multiple loads) of laundry to be washed and dried. In particular, the programmable automated clothes washer, transfer, and dryer system goes through the wash cycle to wash the laundry clothes, spins the clothes after washing, and then transfers the clothes from the washer to the dryer through the transfer tube. Once the clothes are in the dryer, the dryer starts a drying cycle as programmed.

The programmable automated clothes washer, transfer, and dryer system of the present disclosure may be comprised of the following elements. This list of possible constituent elements is intended to be exemplary only and it is not intended that this list be used to limit the programmable automated clothes washer, transfer, and dryer system of the present application to just these elements. Persons having ordinary skill in the art relevant to the present disclosure may understand there to be equivalent elements that may be substituted within the present disclosure without changing the essential function or operation of the programmable automated clothes washer, transfer, and dryer system.

1. Modified and programmable clothes washing machine (in some embodiments, a top loaded washing machine).

2. Clothes transfer apparatus (also referred to as the "transfer device" or the "transfer tube"). The clothes transfer apparatus is internally connected to the washer and the dryer and provides a transfer mechanism to automatically move washed clothes from the washer to the dryer without human intervention or involvement.

3. Modified and programmable dryer.

The various elements of the programmable automated clothes washer, transfer, and dryer system of the present disclosure may be related in the following exemplary fashion. It is not intended to limit the scope or nature of the relationships between the various elements and the following examples are presented as illustrative examples only. To use the programmable automated clothes washer, transfer, and dryer system of the present disclosure, a person ("user") would start with a washing machine that can be programmed or is modified/adapted to be programmed to go through the wash cycle and spin cycle. The user would not need to manually transfer the clothes from the washer to the dryer because, at the end of the spin cycle, the clothes would automatically be sent through the clothes transfer apparatus and into the dryer. The dryer, being programmable or modified/adapted for programming, would have its own program settings in which, once the wet clothes from the washer (via the clothes transfer apparatus) are deposited inside, the dryer would start its own drying cycle (per the program). In this way, the user would be mostly left free from the work involved in washing, drying, and/or transferring the clothes.

More specifically, the programmable automated clothes washer, transfer, and dryer system of the present disclosure generally works by automation through programming and device/machine adaptations and configurations that enable fully automated washing and drying of laundry. Furthermore, embodiments of the programmable automated clothes washer, transfer, and dryer system with the upper cabinet included allow the user to set up washing for multiple loads of laundry, which are washed in sequence according to pre-programmed settings and the relative placement of each load of laundry in the upper cabinet. That is, the washer starts washing a first load of laundry that dropped into the washer tub from the upper cabinet, washes the clothes as programmed followed by the spin cycle and, at the completion of the spin cycle, sends the clothes through the transfer path (device) and into the dryer. In some embodiments, the dryer starts spinning when the washer is at the end of the spin cycle to assist the clothes transfer system as the clothes approach the dryer through the transfer path and come into the dryer. After the clothes transfer to the dryer is complete, the washer opens the cover of the washing machine to allow the upper cabinet to release the next load of laundry into the tub of the washer, and start washing. Since there are multiple loads of laundry in the process of washing/drying, a third load of laundry waiting in the upper cabinet to be washed would presumably be held up until there is availability to start washing. For that to happen, the first load of laundry needs to be removed from the dryer after the drying cycle is completed. The dryer of the programmable automated clothes washer, transfer, and dryer system handles this by way of an automated laundry removal system at the bottom of the dryer. By automatically removing the dry clothes from the interior of the dryer, the dryer itself would be ready to receive more wet clothes from the washer (via the clothes transfer apparatus). Accordingly, the second load of laundry would be transferred as wet clean clothes through the transfer path and into the dryer and the dryer would start the drying cycle. Now, with the tub of the washer having available space for a new load, the washer would release the cover and the upper cabinet would drop the third load of laundry into the tub to start the next programmed laundry wash. This cycle continues for additional loads of laundry and according to the pre-programmed settings from the user.

In some embodiments, the programmable automated clothes washer, transfer, and dryer system would be deployed as a combination system with a washer, a dryer, and the transfer mechanism, with optional upper cabinet. In a preferred embodiment, the clothes washing machine for the programmable automated clothes washer, transfer, and dryer system would be capable of spinning at both low and high speeds and operating in a reverse direction. The clothes washing machine would also be programmable for multiple loads, capable of dispensing laundry detergents and fabric softeners at specified times, capable of adjusting run times in accordance with pre-programmed run times for different loads of laundry, and consistently adhering to the programming to run for the correct wash cycle times as well as being able to send clothes into the transfer system and into the dryer at pre-programmed times and coordinates with pre-programmed dryer times. In some embodiments, the clothes transfer apparatus of the programmable automated clothes washer, transfer, and dryer system would be fabricated from a transfer tube that connects the washer to the dryer and allows the clothes to travel from the washer to the dryer.

By way of example, FIG. 1 conceptually illustrates a programmable automated clothes washer, transfer, and dryer system 100. As shown in this figure, the programmable automated clothes washer, transfer, and dryer system 100 comprises a programmable automated clothes washing machine 110 with a lifting screw 180, and an internal washer drum 130. In this view, there is a load of laundry 120 inside the washer drum 130.

The programmable automated clothes washer, transfer, and dryer system 100 further comprises a programmable automated dryer 150. The programmable automated dryer 150 comprises an internal dryer drum 160, a plurality of expandable dryer fins 170 within the dryer drum 160, and a one-way spring loaded valve 190 at an interior rear location (or "back") of the dryer drum 160. The one-way spring loaded valve 190 provides ingress from a back side of the dryer 150 for washed laundry to be pushed or forced through the one-way spring loaded valve 190 into the interior space within the dryer drum 160.

The programmable automated clothes washer, transfer, and dryer system 100 further comprises a clothes transfer apparatus 140 that provides a clothes transfer path (also referred to as the "enclosed transfer path") between, and at the back sides of, the programmable automated clothes washing machine 110 and the programmable automated dryer 150. An example of the transfer path is described below, by reference to FIG. 2. The clothes transfer apparatus 140 (also referred to as the "clothes transfer tube 140" or, simply, the "transfer tube 140") is fabricated to form a curved cylinder with open ends that provides a path through which washed laundry from the programmable automated clothes washing machine 110 can be automatically transferred into the programmable automated dryer 150. By way of example, the clothes transfer tube 140 is something like a trough that runs around the top of the programmable automated clothes washing machine 110 and then forms a funnel into a tube that goes to the programmable automated dryer 150. If the programmable automated clothes washing machine 110 sits to the left of the programmable automated dryer 150 (from the perspective of a person facing them) and the programmable automated clothes washing machine 110 spins clock wise, the tunnel (transfer tube 140) will start at the approximate one o'clock position.

Also, the clothes transfer tube 140 of some embodiments has small ball bearings spaced throughout the interior wall or surface of the tube to aide in reducing friction of the load of laundry 120 against the wall/surface of the transfer tube 140. In this way, the load of laundry 120 may move smoothly through the clothes transfer apparatus 140 from the programmable automated clothes washing machine 110 to the programmable automated dryer 150. Furthermore, in some embodiments, the curved cylinder of the transfer tube 140 has a diameter sufficient to transfer laundry articles of any size capable of fitting in the washer drum 130 of the programmable automated clothes washing machine 110. In some embodiments, the clothes transfer apparatus 140 is fabricated to have differing diameters along different sections of the transfer tube 140. In some embodiments, the clothes transfer apparatus 140 is formed with a slightly smaller diameter in a middle part of the transfer tube 140 than the diameter of the rest of the clothes transfer apparatus 140.

The curved cylindrical path of the clothes transfer apparatus 140 is formed to connect a first open end to the programmable automated clothes washing machine 110 and a second (opposite) end to the programmable automated dryer 150. Furthermore, the clothes transfer apparatus 140 connects to the programmable automated clothes washing machine 110 at a vertical height that is higher than the vertical height along the back side of the programmable automated dryer 150 at which the clothes transfer apparatus 140 connects to the one-way spring loaded valve 190. Accordingly, the clothes transfer apparatus 140 is fabricated to slope downward in some embodiments. In this way, the clothes transfer apparatus 140 provides the enclosed transfer path through which washed laundry can be transferred automatically from the programmable automated clothes washing machine 110 to the programmable automated dryer 150. Also, the clothes transfer apparatus 140 of some embodiments comprises a plurality of ball bearings that line an interior surface of the transfer tube.

Also, in some embodiments, the programmable automated dryer 150 starts to spin during the transfer cycle in order to prevent clogging of the clothes at the dryer entry port (which is a gap, aperture, hole, etc.) and through the one-way spring loaded valve 190. In some embodiments, the plurality of expandable dryer fins 170 are configured to pull the clothes entering the dryer drum 160 out of the way to give room for more clothes in the load of laundry 120 being transferred through the clothes transfer apparatus 140. As all of the clothes from the load of laundry 120 gets pushed/pulled into the interior of the dryer drum 160, the programmable automated dryer 150 of some embodiments performs its pre-programmed drying cycle to dry the load of laundry 120. In some embodiments, a new load of laundry is dropped into the programmable automated clothes washing machine 110 to start washing as the programmable automated dryer 150 begins is drying cycle. Examples of multiple loads of laundry being automatically washed and dried are described further below, by reference to FIGS. 7 and 8.

Figure 2:
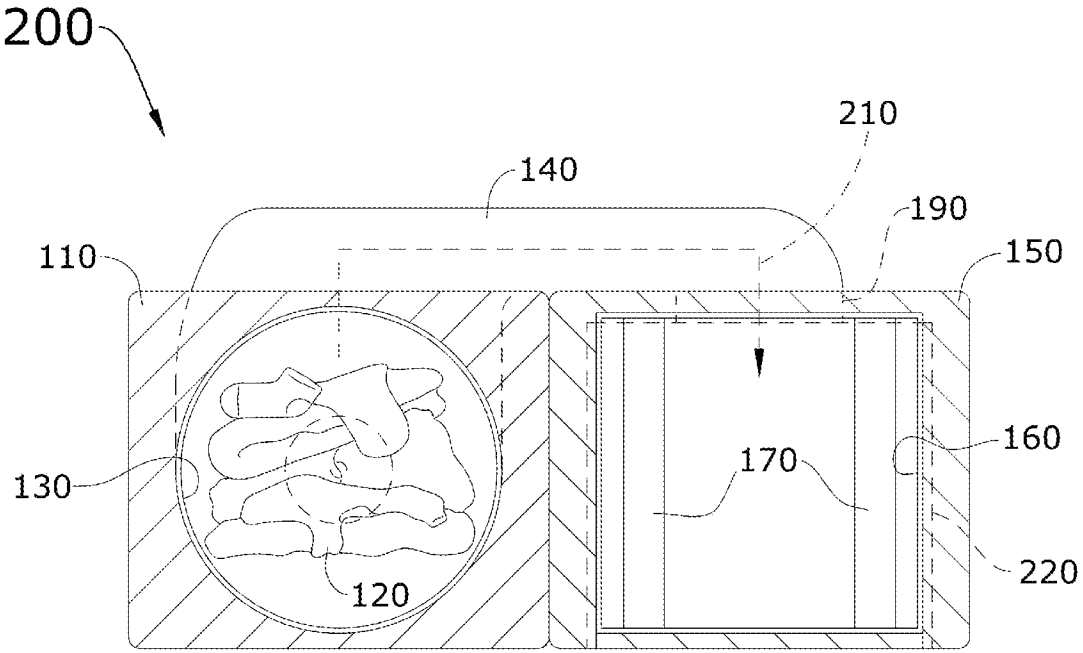
FIG. 2 conceptually illustrates a schematic section view, taken along 2-2 in FIG. 1, of the washing machine and the dryer of the programmable automated clothes washer, transfer, and dryer system in some embodiments without the laundry pre-load cabinet showing.

Turning to another view, FIG. 2 conceptually illustrates a schematic section view 200, taken along 2-2 in FIG. 1, of the programmable automated clothes washing machine 110 and the programmable automated dryer 150 of the programmable automated clothes washer, transfer, and dryer system 100. As shown in this top-down view, the load of laundry 120 is present within the washer drum 130 of the programmable automated clothes washing machine 110. A laundry transfer path 210 outlines the general path through the clothes transfer apparatus 140 that the laundry 120 will travel and through the one-way spring loaded valve 190 and, finally, into the interior space within the dryer drum 160 of the programmable automated dryer 150. Also shown in this figure is a catch tray 220 that is placed within a catch tray storage area of the programmable automated dryer 150 in some embodiments. Also note that the catch 220 is optional as some programmable automated dryers do not have a catch tray storage area, but merely use laundry baskets or catch trays that are placed in front of a door of the programmable automated dryer 150.

Figure 3:
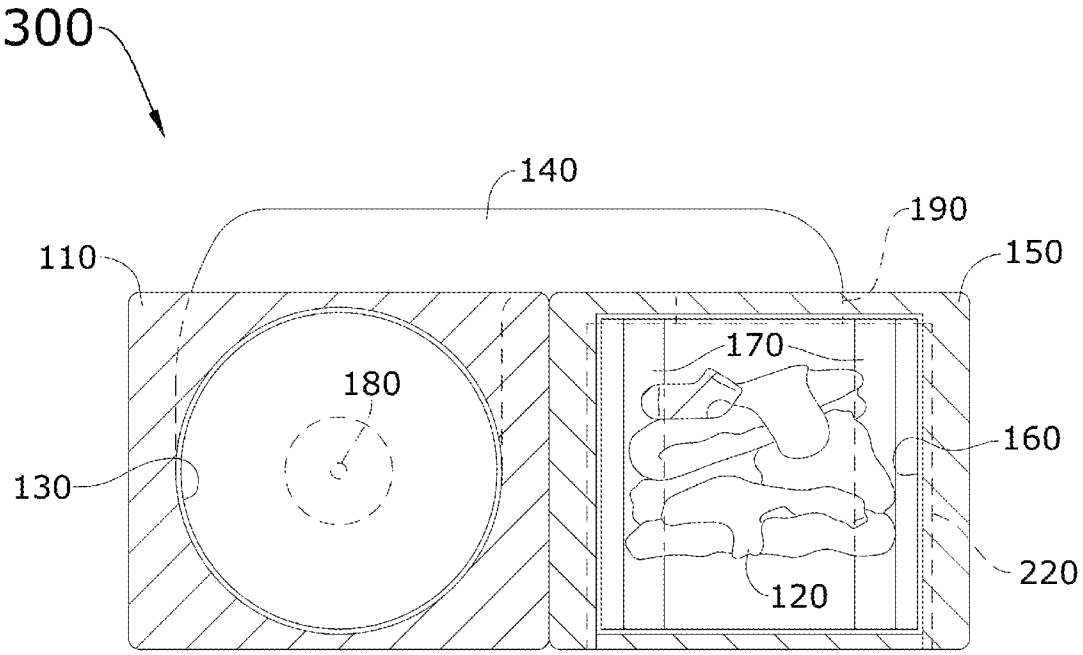
FIG. 3 conceptually illustrates a schematic section view showing the load of laundry in the dryer after transfer from the washing machine.

By way of another example, FIG. 3 conceptually illustrates a schematic section view showing the load of laundry 120 in the interior space within the dryer drum 160 of the programmable automated dryer 150 after transfer through the clothes transfer apparatus 140 from the programmable automated clothes washing machine 110. As can be seen here, the lifting screw 180 within the washer drum 130 of the programmable automated clothes washing machine 110 is free of any clothing or laundry items, since the load of laundry 120 has been transferred entirely to the programmable automated dryer 150. In some embodiments, the programmable automated dryer 150 starts automatically after all articles of laundry have been transferred through the transfer tube 140 and pushed into the dryer drum 160 through the one-way spring loaded valve 190. In some embodiments, the lifting screw 180 is configured to automatically lower down to the original bottom level within the programmable automated clothes washing machine 110 after all of the clothing items of the load of laundry 120 are successfully transferred into the dryer drum 160 of the programmable automated dryer 150. In some embodiments, the programmable automated dryer 150 is then ready to start drying the clothes according to the programmed settings and parameters set or selected by the user. General operation of the programmable automated clothes washer, transfer, and dryer system 100 is described next.

Specifically, the programmable automated clothes washer, transfer, and dryer system 100 works by raising the lifting screw 180 as the spin cycle of the programmable automated clothes washing machine 110 operates. The spinning starts slowly (low RPM as the lifting screw 180 rises up to raise the agitator). This lifts the clothes (or pushes the clothes) upward from the bottom of the washer drum 130 toward the top of the washer drum 130. Also, as the lifting screw 180 rises up further, the RPMs of the spin cycle increase to create significant centrifugal force that pins the clothes to the outer circular surface of the washer drum 130. Consequently, when the lifting screw 180 is raised up near the top of the washer drum 130, the load of laundry 120 is also be raised up within the washer drum 130 until it is near or at a level of an outlet channel. The outlet channel is a hole, cavity, aperture, or other space in the back side surface of the programmable automated clothes washing machine 110. Specifically, the outlet channel is exposed along the back side surface and around the top of the programmable automated clothes washing machine 110. One of the open ends of the clothes transfer apparatus 140 attaches to the outlet channel of the programmable automated clothes washing machine 110. As the load of laundry 120 is being raised up by the lifting screw 180, the washer drum 130 continues to spin at increasing RPMs, which results in significant centrifugal force being applied to the laundry 120, and hence, causes the laundry to pin to the inner circular surface of the washer drum 130. With this centrifugal force being applied at the top, when the clothes are approximately at the level of the outlet channel, the programmable automated clothes washing machine 110 is able to funnel or otherwise deposit the washed laundry 120 into the clothes transfer apparatus 140. While the centrifugal force has a large role in pushing the laundry 120 into the transfer tube 140, it also has an impact in pushing the clothes through the tube. That is, when the load of laundry 120 reaches the top of the washer drum 130 near the outlet channel, the centrifugal force from the spinning causes the clothes to be pushed outward so that clothes start moving through the outlet channel and into the clothes transfer apparatus 140. As more clothes enter the transfer tube 140, the downward slope of the tube along with the force from spinning pushes against all the clothes to push them further down and through the transfer tube 140. As noted above, the clothes transfer apparatus 140 of some embodiments is lined with ball bearings which further aides in transferring the laundry through the transfer tube 140.

As noted above, the clothes transfer apparatus 140 is fabricated to form a curved cylinder with open ends at both sides. The first opening attaches to the outlet channel of the programmable automated clothes washing machine 110. The other open end, or rather, a second open end of the clothes transfer apparatus 140 connects to the one-way spring loaded valve 190 at the back of the programmable automated dryer 150 and enters the center of the dryer drum 160 through the one-way spring loaded valve 190. As such, an inlet channel is positioned along the back side surface of the dryer at the location of the one-way spring loaded valve 190. The inlet channel (e.g., a hole, a cavity, an aperture, or another space in the back side surface of the programmable automated dryer 150) is the connection point for the second open end of the clothes transfer apparatus 140 to connect to the programmable automated dryer 150 and, accordingly, provides the ingress path for the load of laundry 120 into the dryer drum 160 of the programmable automated dryer 150. Furthermore, as noted above, the clothes transfer apparatus 140 is lined along the inner cylinder surface with ball bearings to aide in movement of the clothes down through the transfer pathway and into the dryer drum 130 through the one-way spring loaded valve 190. In some embodiments, the diameter of the clothes transfer apparatus 140 is approximately the same diameter throughout the clothes transfer apparatus 140. In some other embodiments, the diameter of the clothes transfer apparatus 140 is slightly reduced in a small middle section of the clothes transfer apparatus 140. The slight reduction in diameter in the middle of the clothes transfer apparatus 140 creates a Venturi effect that provides additional assistance to aide the transfer of the clothes from the washing machine 110 to the programmable automated dryer 150.

After the load of laundry 120 is transferred into the interior dryer drum 160 of the programmable automated dryer 150, the drying cycle is automatically triggered to start, according the user's set or selected program and settings. This is demonstrated next, by reference to FIGS. 4 and 5.

Figure 4:
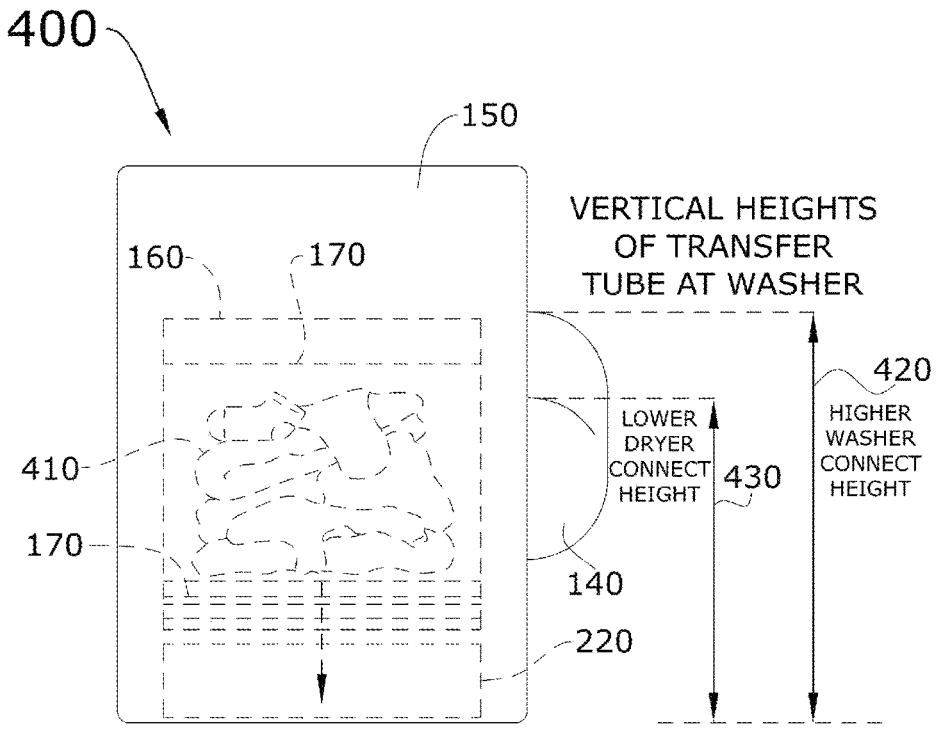
FIG. 4 conceptually illustrates a schematic side view of the dryer with a dry clothes in some embodiments.
Figure 5:
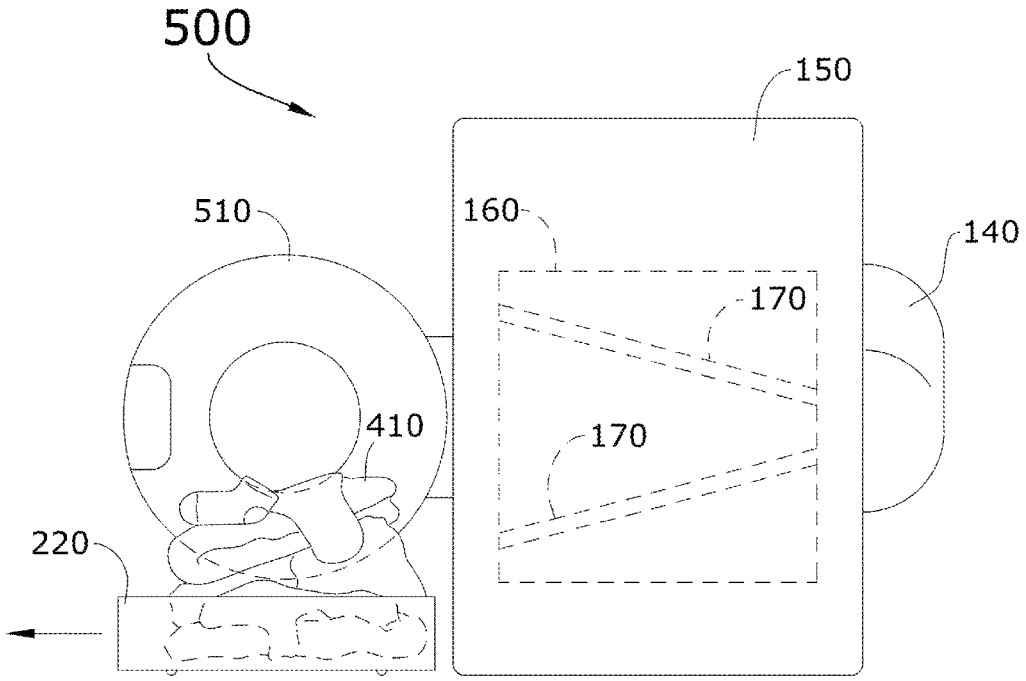
FIG. 5 conceptually illustrates a schematic side view of the dryer with the dry clothes moving out of the dryer via cabinet in some embodiments.

Specifically, FIG. 4 conceptually illustrates a schematic side view of the programmable automated dryer 150 and the clothes transfer apparatus 140, with the downward slope of the clothes transfer apparatus 140 shown via different vertical connection points to the washing machine 110 and the dryer 150. As shown in this figure, dry clothes 410 are present in the dryer drum 160 of the programmable automated dryer 150 upon completion of the drying cycle. In some embodiments, the dry clothes 410 are automatically released into the catch tray 220 which is automatically pushed out of the catch tray storage area when the drying cycle completes. In some other embodiments, there is no catch tray storage area and the catch tray 220 is manually placed in front of the programmable automated dryer 150 by a user or the user manually removes the dry clothes from the interior space of the dryer drum 160 of the programmable automated dryer 150.

Also shown in this figure is an example of different connection port heights of the programmable automated clothes washing machine 110 and the programmable automated dryer 150 to which the open ends of the clothes transfer apparatus 140 are attached. Specifically, the clothes transfer apparatus 140 is shown in this figure as sloping downward from a higher washer connect height 420 to a lower dryer connect height 430.

In some other embodiments, there is no catch tray storage area under the programmable automated dryer 150. When that is the case, the programmable automated dryer 150 may be configured to automatically open a front dryer door and release the dry clothes 410 into the catch tray 220 or another basket (when positioned in front of the front dryer door), or simply allow the user to remove the dry clothes 410 manually. This is demonstrated in FIG. 5, which conceptually illustrates a schematic side view of the programmable automated dryer 150 with the dry clothes 410 being pushed out of the programmable automated dryer 150 through the front dryer door 510 via the expandable dryer fins 170. Specifically, the expandable dryer fins 170 of some embodiments push the clothes out of the programmable automated dryer 150 onto the catch tray 220 or other basket. In some embodiments, the expandable dryer fins 170 are jointed to allow them to move and create a funnel to push the dry clothes 410 out through the front dryer door 510 of the programmable automated dryer 150. In some embodiments, after all of the dry clothes 410 have been pushed out of the programmable automated dryer 150, the front dryer door 510 automatically closes. The automatic closing of the front dryer door 510 is electrically driven and based on one or more sensors detected that there are no obstructions from the dry clothes 410 either in front of the door 510 or in the dryer drum 160. The automatic closing of the front dryer door is, therefore, like automatic door and trunk closing systems of automobiles and other such automated release and closing systems. However, other automated systems may be used for opening/closing the front dryer door 510 including, without limitation, hydraulic systems, hybrid electric/hydraulic systems, etc. While not mentioned above, the programmable automated clothes washing machine 110 of some embodiments includes a hydraulically operated automatic opening/closing top washer lid, which is described further below, by reference to FIG. 7.

Figure 6:
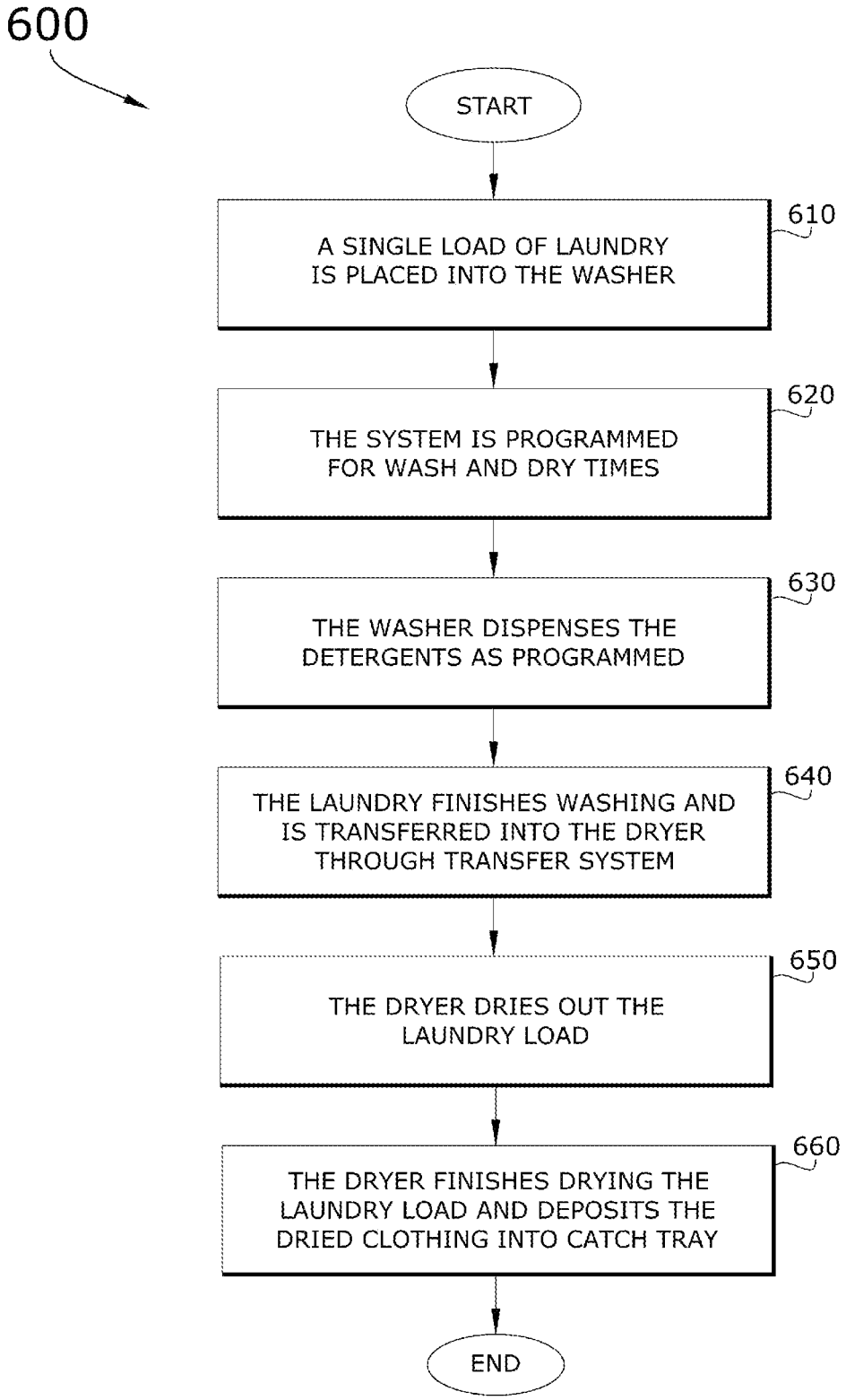
FIG. 6 conceptually illustrates an automated home clothes washing and drying process for automating a wash and dry cycle for a single load of laundry in some embodiments.

Now, turning to another example, FIG. 6 conceptually illustrates an automated home clothes washing and drying process for automating a wash and dry cycle for a single load of laundry 600. As shown in this figure, the automated home clothes washing and drying process for automating a wash and dry cycle for a single load of laundry 600 starts when a single load of laundry is placed into the programmable automated clothes washing machine (at 610). Next, the programmable automated clothes washer, transfer, and dryer system is programmed for washer and dryer times (at 620). In some embodiments, in addition to programming washer and dryer times, the programmable automated clothes washer, transfer, and dryer system is programmed with other settings, such as wash load selection type, water temperature during wash, soak, rinse cycles, spin cycle speed, detergents and other cleansing and conditioning options, etc.

In some embodiments, the automated home clothes washing and drying process for automating a wash and dry cycle for a single load of laundry 600 proceeds to the next step during which the programmable automated clothes washing machine automatically dispenses the selected/programmed detergents and other cleansing and conditions solutions into the appropriate detergent containers of the programmable automated clothes washing machine and also automatically releases the detergents, cleansers, or other conditioning solutions at wash cycle times based on the program settings of the user (at 630). Next, the load of laundry is cleaned as the programmable automated clothes washing machine finishes the wash and rinse cycles. At this point, the automated home clothes washing and drying process for automating a wash and dry cycle for a single load of laundry 600 proceeds to the next step for transferring the cleaned/washed clothes from the programmable automated clothes washing machine to the programmable automated dryer through the clothes transfer apparatus (at 640). Then the automated home clothes washing and drying process for automating a wash and dry cycle for a single load of laundry 600 continues with the next step to trigger the programmable automated dryer to start drying the load of laundry (at 650). When the programmable automated dryer finishes the drying cycle and the clothes are dried, the automated home clothes washing and drying process for automating a wash and dry cycle for a single load of laundry 600 moves forward to the final step at which the dried clothes are automatically deposited out of the programmable automated dryer and into the catch tray or other basket in position to catch the dried clothes. As this process is for a single load of laundry, the automated home clothes washing and drying process for automating a wash and dry cycle for a single load of laundry 600 ends after the dried clothes are deposited out of the programmable automated drier.

Although many of the descriptions above focus on a single load of laundry, one should understand that the programmable automated clothes washer, transfer, and dryer system is both operator friendly and highly versatile. The versatility is evident is the many different programming options, settings, and configurations that a user can manually program or the many pre-programmed automated laundry cycle options from which the user may select. In addition, the programmable automated clothes washer, transfer, and dryer system is configured to automate the cleaning and drying of multiple loads of laundry by similar programmed settings or selections of a user, but in connection with an upper cabinet the is automated in a synchronized manner with the programmable automated clothes washing machine. That is, the upper cabinet is automated to release single loads of laundry in synchronized and automated ways that correspond to the progress of with the programmable automated clothes washing machine and the programmable automated dryer. Meanwhile, other pre-loaded laundry is stored in separate shelves of the upper cabinet waiting to be washed. For example, an operator (or user) can program two loads of laundry to wash and dry. The operator can simply come back when the two loads are done, or the operator can configure the settings to automatically send a digital communication (e.g., text message, email, etc.) to a device of the operator when finished. Another option is for the operator to program the wash and dry cycles to stop at specified times.

In some embodiments, the processing unit of the programmable automated clothes washer, transfer, and dryer system runs each laundry cycle program according to the programmed user settings and selections and alerts the user when each load of laundry is washed and dried, or alerts the user when all loads of laundry are washed and dried, according to user-specified alert, notification, and communication settings. For example, the computing device processing unit with a WiFi wireless communication module may be configured (by user settings) to generate and send a text-based alert to a phone number of a mobile device operated by the user or an email message alert to an email address specified by the user. Furthermore, the user may configure alert, notification, and/or communication settings to be alerted when human attention is needed to resolve a detected problem or issue with the processing unit of the programmable automated clothes washer, transfer, and dryer system. Similarly, communication notification settings can be specified by the user to send a notification with a pre-programmed time elapses and certain user attention is required. For example, when the user sets a reduced dry cycle time, which elapses and user needs to check if further drying time is required, or if the operator wants to wash a load of laundry without drying, so the processing unit of the programmable automated clothes washer, transfer, and dryer system is programmed accordingly (e.g., stop after wash cycle completed, but before transfer cycle/drying cycle). Similar incidental notifications can be configured and sent, such as if the user wants to add dryer sheets at the start of the dry cycle for a specific load, an alert will be sent via WiFi to the device operated by the user (e.g., computer or cell phone) notifying the user that it is ready.

In some embodiments, the programmable automated clothes washer, transfer, and dryer system further comprises an automated upper cabinet that is communicably connected to the programmable automated clothes washing machine and the programmable automated dryer. In some embodiments, the programmable automated clothes washing machine comprises a washer control unit that runs wash cycle programs specified or selected by an operator. In some embodiments, the programmable automated dryer comprises a dryer control unit that runs dryer cycle programs specified or selected by the operator. In some embodiments, the automated upper cabinet comprises a cabinet control unit that releases loads of laundry when directed.

Figure 7:
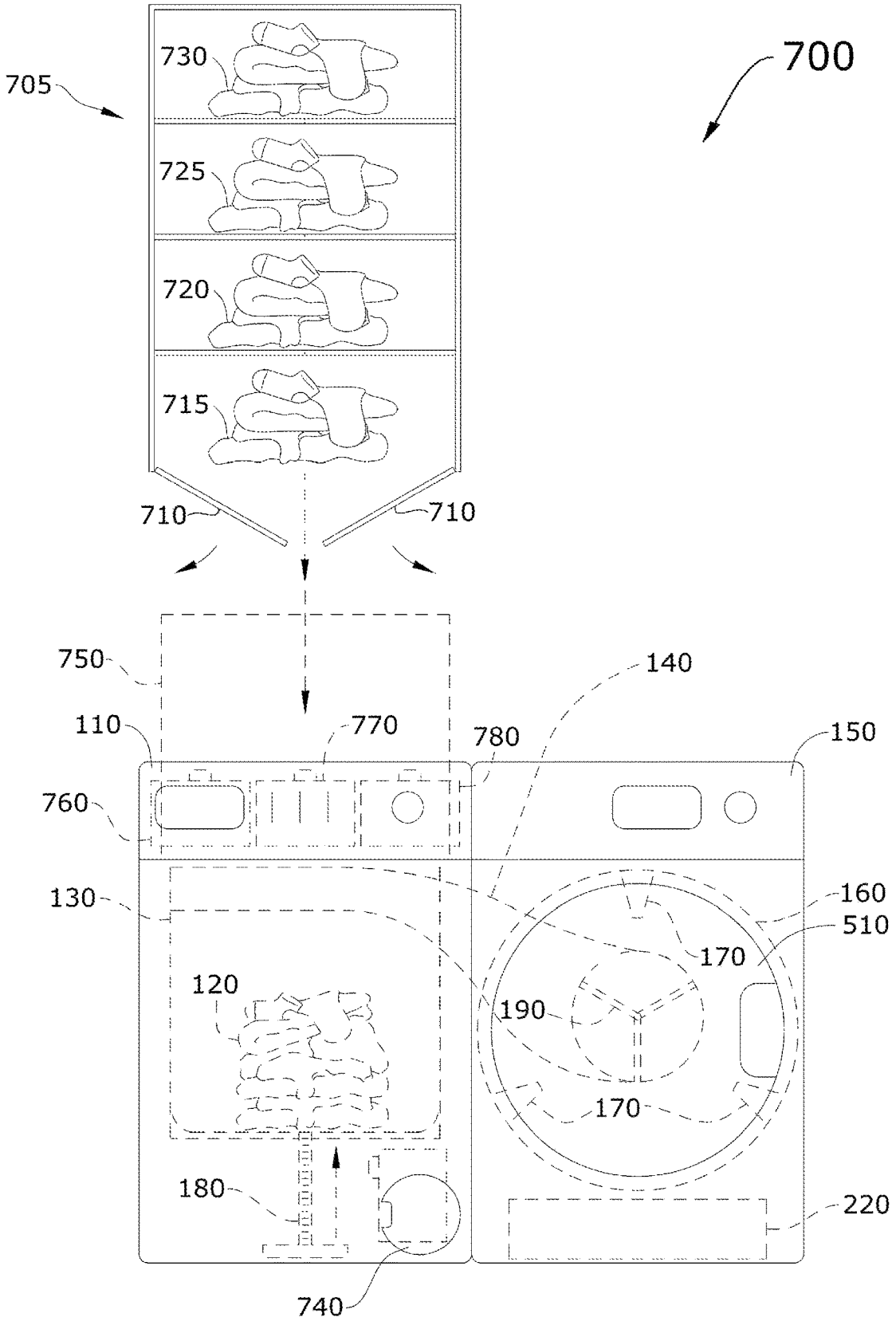
FIG. 7 conceptually illustrates an enhanced programmable automated clothes washer, transfer, and dryer system with a programmable automated laundry pre-load cabinet in some embodiments.

By way of example, FIG. 7 conceptually illustrates an enhanced programmable automated clothes washer, transfer, and dryer system 700 with a programmable automated laundry pre-load cabinet 705. As shown in this figure, the enhanced programmable automated clothes washer, transfer, and dryer system 700 comprises the programmable automated laundry pre-load cabinet 705, the programmable automated clothes washing machine 110 (with the lifting screw 180, the internal washer drum 130, and the load of laundry 120 inside), and the programmable automated dryer 150 (with the internal dryer drum 160, the plurality of expandable dryer fins 170, and the one-way spring loaded valve 190). The programmable automated laundry pre-load cabinet 705 includes a plurality of automatic laundry release doors 710. Each pair of automatic laundry release doors act as cabinet shelves to hold individual loads of laundry when the pair of automatic laundry release doors have not flapped open to release the load of laundry. As shown in this figure, there are a plurality of loads of cabinet-loaded laundry 715-730 placed on the shelves of the programmable automated laundry pre-load cabinet 705. Also, each shelf is designed to store only one load of cabinet-loaded laundry. Unlike the one-way spring loaded valve 190 of the programmable automated dryer 150, the automatic laundry release doors are not spring-loaded because after each pair of doors are automatically released, they remain open so that the next pair of doors may be released to let the next load of cabinet-loaded laundry drop down into the washer tub. In some embodiments, the automatic laundry release doors 710 are automatically opened electronically. In some embodiments, the automatic laundry release doors 710 are automatically opened hydraulically. In some embodiments, the automatic laundry release doors 710 are manually manipulated by the user back into the shelf configuration. This would be typically the case after all loads of cabinet-loaded laundry have been released to drop into the washer.

Now turning to the programmable automated clothes washing machine 110, a pressure tank door 740, a washer lid 750, a liquid detergent container 760, a liquid bleach container 770, and a liquid fabric softener container 780 join the lifting screw 180 and the internal washer drum 130 (with a load of laundry 120 inside) as components of the programmable automated clothes washing machine 110. In some embodiments, the washer lid 750 is configured to open and close automatically by direct command signal (or "system signal") specified by a main system control unit (not shown in this figure, but included as a component of all embodiments of the programmable automated clothes washer, transfer, and dryer system). An example of a main system control unit is described further below, by reference to FIG. 9. In some embodiments, the washer lid 750 is a hydraulically operated automatic opening/closing top washer lid 750 that is configured to open and close automatically (via a system signal to open or close) and without human intervention. In some embodiments, a human operator may open or close the washer lid 750 manually when not directed to open or close by system signal.

For the programmable automated dryer 150, the internal dryer drum 160, the plurality of expandable dryer fins 170, and the one-way spring loaded valve 190 are all shown in this view. In addition, the programmable automated dryer 150 includes the catch tray 220 and the dryer door 510. Also, the clothes transfer apparatus 140 is revealed in this figure between, and at the back sides of, the programmable automated clothes washing machine 110 and the programmable automated dryer 150.

In some embodiments, a user may program a complete automated program cycle for the load of laundry 120 already placed in the programmable automated clothes washing machine 110, a first load of cabinet-loaded laundry 715 ready for release from the programmable automated laundry pre-load cabinet 705, and second, third, and fourth loads of cabinet-loaded laundry 720-730 placed on successively higher shelves of the programmable automated laundry pre-load cabinet 705.

For example, the user may lift (open) the washer lid 750 and manually place the load of laundry 120 into the internal washer drum 130 of the programmable automated clothes washing machine 110, and contemporaneously place the other loads of laundry 715-730 on the shelves of the programmable automated laundry pre-load cabinet 705. The user may then program a complete automated program cycle by individually programming the laundry cycle for each load of laundry to be washed and/or dried. In some embodiments, programming the laundry cycles of a complete automated program cycle for successive loads of laundry is an ordered activity of the user, such as that a first program input by the user corresponds to a first load of laundry, a second program input by the user corresponds to a second load of laundry, and so on. In some other embodiments, each program input in a complete automated program cycle can be associated with a laundry load identifier. Thus, programming by the user would include the user specifying a laundry load identifier for each successive load of laundry to wash/dry. The laundry load identifier can be based on a simple numbering scheme that corresponds to each successive load of laundry. For example, a first program and an identifier value of one entered by the user would associate the first program with a first load of laundry, a second program and an identifier value of two entered by the user would associate the second program with a second load of laundry, and so on. Also, when a sequential numbering system is utilized, the user can program the various loads of laundry in any order, just so long as the user specifies the precise numeric identifier of each load of laundry. For instance, the user may input a laundry load identifier value of 'n' that corresponds to either the current load in the wash drum 130 or a load of cabinet-loaded laundry placed on one of the shelves of the upper cabinet 705. Later, the user may change the laundry load identifier for the specified load of laundry to a different laundry load identifier value, say 'o', and re-assign the laundry load identifier value 'n' with a new load of laundry placed on one of the shelves of the cabinet (e.g., by the user closing the open flap release doors 710 of, say, the bottom shelf of the cabinet after a couple of loads of laundry from the cabinet have been released and washed). Thus, the user has some ability to override, or re-configure, the ordered programming while the system is engaged in washing/drying. To do so, a wash/dry cycle management unit of the main system control unit will sort and execute the programming for the various loads of laundry according to the sequential numbering specified and will account for any updates or changes to the ordered programming in realtime (that is, as it happens). While the wash/dry cycle management unit described above is not shown in this figure, it is included as a component of all embodiments of the programmable automated clothes washer, transfer, and dryer system. An example of the wash/dry cycle management unit is described further below, by reference to FIG. 9.

After the user is done programming the complete automated program cycle, the user may then select an option to start the first wash cycle (or may physically press a "Start" button on the washer). After starting this initial load of laundry, the user may go off and do something else (away from the laundry), and let the automated programs wash and/or dry the several loads of laundry according to each laundry cycle program setting. In this example, when the initial load of laundry 120 is done with the wash cycle, the laundry 120 is automatically transferred through the clothes transfer apparatus 140 to the programmable automated dryer 150 for drying according to the drying cycle program and settings specified by the user. Also, after the washed load of laundry 120 completes the transfer cycle and is entirely present within the interior dryer drum 160 space, the main system control unit of the programmable automated clothes washer, transfer, and dryer system transmits a signal to the programmable automated clothes washing machine 110 to automatically open the washer lid 750. After the washer lid 750 is open, the main system control unit of the programmable automated clothes washer, transfer, and dryer system sends a signal to the programmable automated laundry pre-load cabinet 705 to open the pair of automatic laundry release doors 710 to release the next load of laundry (e.g., the first load of cabinet-loaded laundry 715). This continues according to the settings, parameters, selections, etc., of each individual laundry cycle program in the (overall) complete automated program cycle.

In addition to the usually washing and drying program options, such as a water temperature, spin cycle speed, dry time, amount of heat for drying, etc., the programmable automated clothes washer, transfer, and dryer system of some embodiments is configured to signal the programmable automated clothes washing machine 110 to automatically dispense liquid detergent, liquid bleach, and/or liquid fabric softener based on each laundry cycle program and the corresponding program settings. As shown in this figure, the programmable automated clothes washing machine 110 includes the liquid detergent container 760, the liquid bleach container 770, and the liquid fabric softener container 780. In some embodiments, each container 760-780 is connected to a pump that draws solution from a large source container for each type of liquid, namely, liquid detergent pumped from a large liquid detergent source container into the liquid detergent container 760, liquid bleach pumped from a large liquid bleach source container into the liquid bleach container 770, and liquid fabric softener pumped from a large liquid fabric softener source container into the liquid fabric softener container 780. In some embodiments, the user specifies whether use liquid detergent for a particular load of laundry by selecting YES or NO on a liquid detergent toggle tool. In some embodiments, the user specifies whether use liquid bleach for the particular load of laundry by selecting YES or NO on a liquid bleach toggle tool. In some embodiments, the user specifies whether use liquid fabric softener for the particular load of laundry by selecting YES or NO on a liquid fabric softener toggle tool. Based on these program settings, the programmable automated clothes washing machine 110 will trigger the corresponding pumps to dispense the appropriate liquid solutions into the appropriate container. The user may specify such liquid solution settings for a single program associated with a single load of laundry, or may specify several different liquid solution settings for a plurality of different loads of laundry to wash/dry (e.g., by separate loads of laundry automatically release and dropped down from the cabinet) as programmed in a complete automated program cycle.

Figure 8:
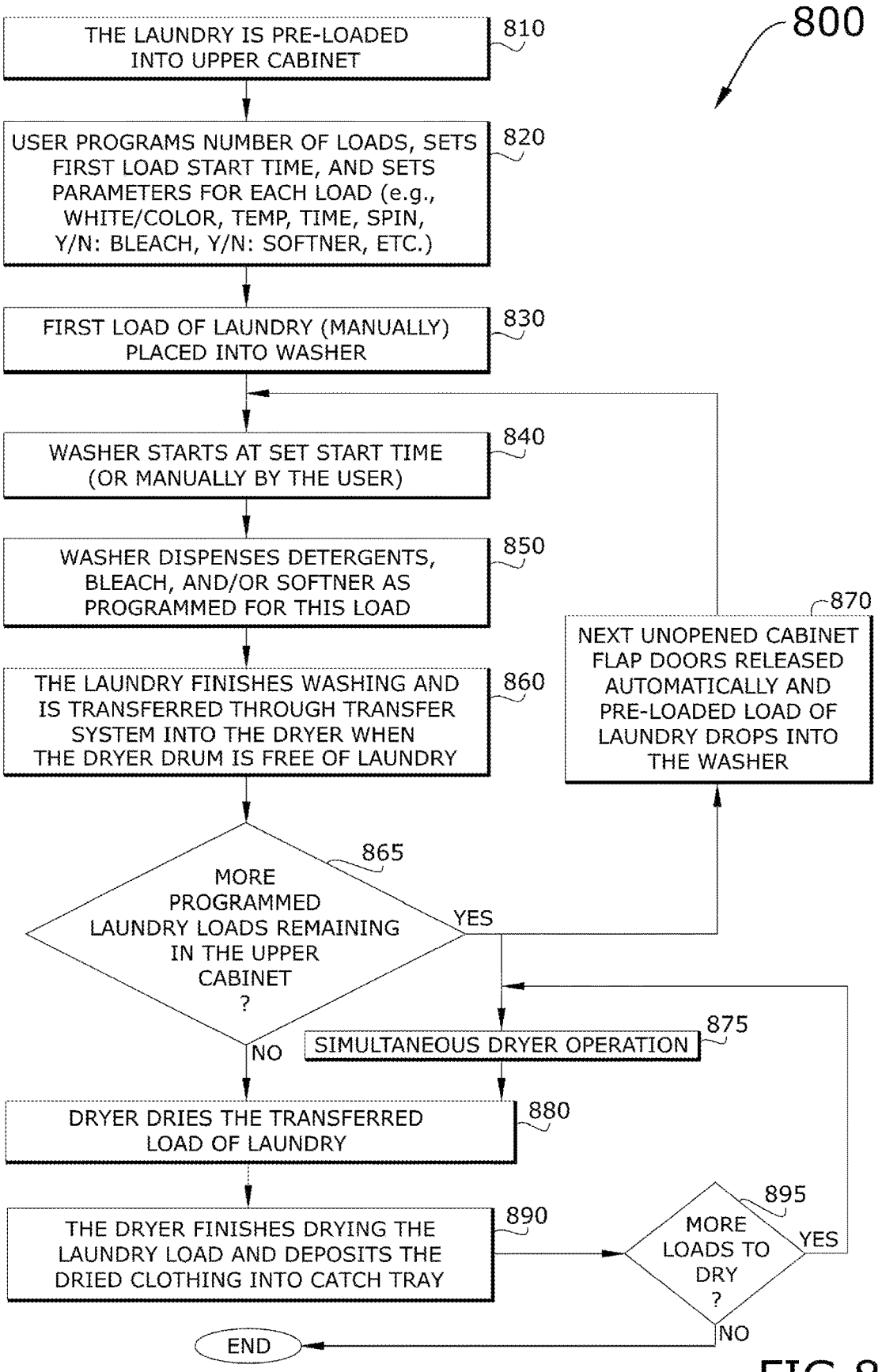
FIG. 8 conceptually illustrates an enhanced automated home clothes washing and drying process for filling an automated laundry pre-load cabinet with several loads of laundry to program several automated wash and dry cycles for the several loads of laundry in some embodiments.

Now, turning to another example of multiple loads of laundry that can be programmed for washing and/or drying, FIG. 8 conceptually illustrates an enhanced automated home clothes washing and drying process 800 for filling an automated laundry pre-load cabinet with several loads of laundry to program several automated wash and dry cycles for the several loads of laundry. As shown in this figure, the enhanced automated home clothes washing and drying process 800 starts with a user pre-loading the laundry into the upper cabinet (at 810) and then programming the complete automated program cycle (at 820). For example, the user programs the complete automated program cycle by inputting the number of loads of laundry, setting a start time for the first load (which is pre-loaded in the washer drum already and which may be set with a start time of "NOW" or some future time specified down to the minute of the day), and setting parameters for each load of laundry (e.g., whether the laundry is for whites or colors, water temperature of each load and cycle, time for cycle, spin setting/speed, bleach toggle, detergent toggle, fabric softener toggle, etc.).

Next, if the user has not already done so, the first load of laundry to be washed (according to the complete automated program cycle) is manually placed into the programmable automated clothes washing machine (at 830) and, upon the start time or selection of a start button, the programmable automated clothes washing machine starts the wash cycle (at 840). In some embodiments, the enhanced automated home clothes washing and drying process 800 provides the programmable automated clothes washing machine with the program settings and options specified by the user so that the programmable automated clothes washing machine can dispense detergents, bleach, and/or softener as programmed for the current load of laundry (at 850).

When the laundry finishes the wash cycle in the programmable automated clothes washing machine, the enhanced automated home clothes washing and drying process 800 of some embodiments proceeds to the next step at which the washed clothes are transferred into and through the transfer tube into the programmable automated dryer (at 860), given that the internal area of the dryer drum is free enough to accept the load of laundry being transferred.

In some embodiments, the enhanced automated home clothes washing and drying process 800 then determines (at 865) whether there are any more loads of laundry programmed and remaining to be released from the upper cabinet. When it is determined (at 865) that there are more loads of laundry programmed and remaining to be released from the upper cabinet (YES), the enhanced automated home clothes washing and drying process 800 branches to perform two lines of operation. Specifically, a first line of operations involves the enhanced automated home clothes washing and drying process 800 triggering the automatic opening of the washer lid of the programmable automated clothes washing machine (in the manner described above, by reference to FIG. 7). The second line of the branching by the enhanced automated home clothes washing and drying process 800 involves simultaneous operation of the programmable automated dryer (at 875) to dry the load of laundry that was just deposited into the interior of the dryer drum.

After the first line of branched (simultaneous) operations, the enhanced automated home clothes washing and drying process 800 continues forward to the next step of automatically releasing the next unopened cabinet flap doors to drop the cabinet-loaded load of laundry into the programmable automated clothes washing machine (at 870). Also, just after the load of laundry is dropped into the programmable automated clothes washing machine, the enhanced automated home clothes washing and drying process 800 triggers the automatic closing of the washer lid (prior to starting the wash cycle). Then the enhanced automated home clothes washing and drying process 800 transitions back to the step of starting the programmable automated clothes washing machine for the wash cycle as programmed (at 840).

Turning back to the determination (at 865), when it is determined that there are no more loads of laundry programmed or remaining to be released from the upper cabinet (NO), the enhanced automated home clothes washing and drying process 800 continues moving ahead to the next step for the programmable automated dryer to dry the load of laundry that was just transferred into the dryer (at 880). This is also the step that is performed by the enhanced automated home clothes washing and drying process 800 after the second line of branched (simultaneous) operations involving the simultaneous dryer operation (at 875). In some embodiments, after the dryer finishes drying the laundry, the enhanced automated home clothes washing and drying process 800 proceeds to the next step of pushing out the dried clothing from the dryer and depositing the dried clothing into the catch tray or other basket (at 890). Then the enhanced automated home clothes washing and drying process 800 determines whether there are more loads of laundry to be dried (at 895) based on the settings of to programs in the complete automated program cycle. When there are more loads of laundry to dry (YES), the enhanced automated home clothes washing and drying process 800 transitions back to the step for performing the simultaneous dryer operation (at 875) to have the programmable automated dryer dry the next load of laundry when transferred into the dryer (at 880) and continuing as noted above. On the other hand, when it is determined (at 895) that there are no more loads of laundry to dry, by checking the complete automated program cycle, then the enhanced automated home clothes washing and drying process 800 ends.

As described above, in some embodiments, the programmable automated clothes washer, transfer, and dryer system further comprises a main system control unit with an embedded system processing unit. In some embodiments, the main system control unit is configured to coordinate and manage a laundry cycle program (set or selected by the user) that incorporates and synchronizes one or more of a wash cycle program, cabinet laundry load setting, and a dry cycle program in connection with the washer control unit, the cabinet control unit, and the dryer control unit, respectively for each load of laundry to be washed and dried.

Figure 9:
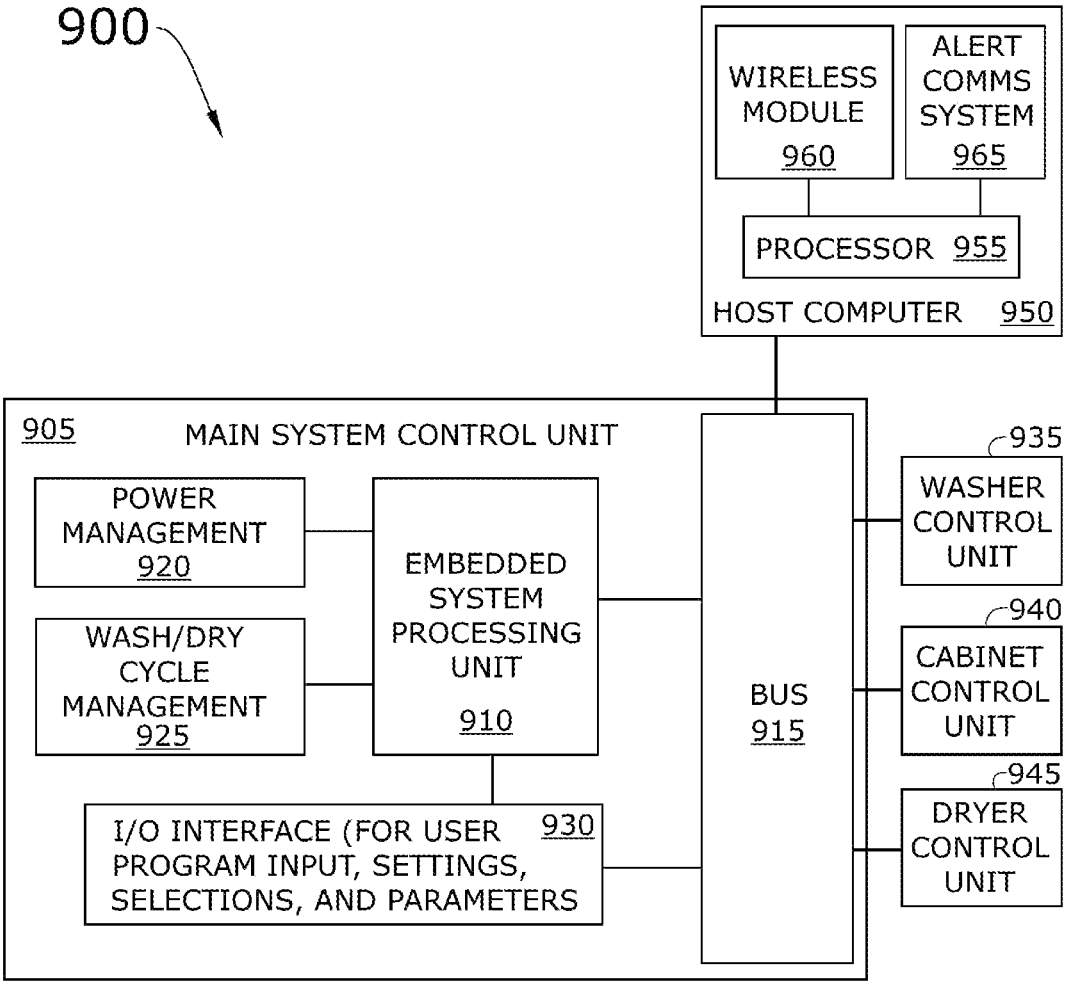
FIG. 9 conceptually illustrates a main system control unit of a programmable automated clothes washer, transfer, and dryer system that coordinates and manages laundry cycle programs for loads of laundry programmed for the washing and/or drying in some embodiments.

By way of example, FIG. 9 conceptually illustrates a control system 900 of the programmable automated clothes washer, transfer, and dryer system with a main system control unit 905. As shown in this figure, the main system control unit 905 comprises an embedded system processing unit 910, a data/communication bus 915, a power management unit 920, a wash/dry cycle management unit 925, and an input/output ("I/O") interface 930 for user program inputs, settings, selections, parameters, and so on. The main system control unit is communicably connected, by way of the data/communication bus 915, to a plurality of other control units of the programmable automated clothes washer, transfer, and dryer system. Specifically, the plurality of other control units comprise a washer control unit 935 that is embedded within or externally connected to the programmable automated clothes washing machine, a cabinet control unit 940 that is embedded within or externally connected to the programmable automated laundry pre-load cabinet, and a dryer control unit 945 that is embedded within or externally connected to the programmable automated dryer. The main system control unit is also communicably connected, by way of the data/communication bus 915, to a host computer 950. In some embodiments, the host computer 950 comprises a processor 955, a wireless module 960, and an alert communication system 965 that is configured to send alerts, notifications, and other information to an operator according to user-specified communication settings.

The control system 900 demonstrates an overall control paradigm of the programmable automated clothes washer, transfer, and dryer system. Specifically, the embedded system processing unit 910 of the main system control unit 905 performs all processing of information received via the data/communication bus 915 from the washer control unit 935, the cabinet control unit 940, the dryer control unit 945, and/or the host computer 950. In some embodiments, user input for programming one or more loads of laundry is entered via a touchscreen display of the programmable automated clothes washing machine, the programmable automated dryer, or a touchscreen display of the host computer 950. In some embodiments, the host computer 950 is a tablet computing device or smartphone with a mobile app that is communicably connected, via the wireless module 960, to the programmable automated clothes washing machine, the programmable automated dryer, and/or the programmable automated cabinet. In some embodiments, the host computer 950 is also communicably connected, via wireless module 960, to the main system control unit 905 and communications with, transmits data to, and receives data from the main system control unit 905 via the data/communication bus 915. Thus, when the user inputs settings, makes selections, chooses options, etc., to program one or more loads of laundry, the data/communication bus 915 of some embodiments receives the data and transmits the date to both the embedded system processing unit 910 and the I/O interface 930. In some embodiments, the I/O interface 930 checks for program completeness and checks for errors in programming. When a program specified by a user is incomplete or contains programming errors, the I/O interface 930 in some embodiments rejects the data and notifies the user, through the host computer 950 alert communication system 965, of the problems. On the other hand, when there are no errors and the program is complete, the I/O interface 930 of some embodiments provides the data to the embedded system processing unit 910. In some embodiments, the I/O interface 930 also stores the data in a memory device or persistent storage embedded in the main system control unit 905 or communicably connected to the main system control unit 905.

In some embodiments, when the embedded system processing unit 910 receives the data specifying a user program for one or more loads of laundry (whether that data arrives directly from the data/communication bus 915 or indirectly via the I/O interface 930), the data is provided to the wash/dry cycle management unit 925 for processing and local storage in connection with ongoing laundry that is being performed or about to be performed. The wash/dry cycle management unit 925 works in conjunction with the power management 920 unit to send program and power control data to the washer control unit 935, the cabinet control unit 940, and/or the dryer control unit 945 via the embedded system processing unit 910 and over the data/communication bus 915. Furthermore, the wash/dry cycle management unit 925 sends trigger signals to the alert communication system 965 on the host computer 950 when specific events are detected as specified by the user or by system-related events (such a problem, malfunction, etc.). In this way, the main system control unit 905 of the programmable automated clothes washer, transfer, and dryer system is able to coordinate and manage laundry cycle programs for loads of laundry programmed for the washing and/or drying.

Also, the main system control unit 905 of some embodiments may be installed as an embedded component within the programmable automated clothes washing machine or the programmable automated dryer, or may be installed as a separate bare-metal machine, such as a single board computer (SBC) system (e.g., an Arduino Uno or a Raspberry Pi) or a device controller. In some embodiments, a touchscreen display is connected to the main system control unit 905, thereby providing direct user input of program settings and selections. Whether installed as an embedded component or an external system that is communicably connected, the main system control unit 905 is not limited to only the exemplary descriptions above, but may be adapted to provide a controller feature for any of several automation systems used in homes or businesses.

Similarly, the above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A programmable automated clothes washer, transfer, and dryer system comprising:

a host computer;

a main system control unit communicably connected to the host computer;

a programmable automated clothes washing machine comprising an internal washer drum in which a load of laundry is placed for washing during an automatic, programmed wash cycle, an outlet channel comprising an aperture at a top level of the internal washer drum, a washer control unit that is configured to control the automatic operation of programmed wash cycle in connection with the main system control unit, and a lifting screw that is configured to spin and raise the load of laundry in the internal washer drum up to the top level after the load of laundry is washed, wherein the internal washer drum increases a speed of spinning as the lifting screw raises the load of laundry to force clothes in the load of laundry to exit the internal washer drum through the aperture of the outlet channel at the top level, wherein the increased speed of spinning results in centrifugal force that forces the clothes to exit the internal washer drum through the aperture of the outlet channel at the top level;

a programmable automated dryer comprising a dryer control unit that is configured to control automatic operation of drying cycles in connection with the main system control unit, an internal dryer drum, and a one-way spring loaded valve that provides ingress into the internal dryer drum for washed clothes to be automatically dried by the dryer as controlled by the dryer control unit; and a clothes transfer apparatus comprising a first open end that connects to the aperture of the outlet channel at the top level of the internal washer drum at a back side of the programmable automated clothes washing machine and a second open end that connects to the one-way spring loaded valve of the programmable automated dryer, wherein the clothes transfer apparatus provides a clothes transfer path between the programmable automated clothes washing machine and the programmable automated dryer.

2. The programmable automated clothes washer, transfer, and dryer system of claim 1, wherein the one-way spring loaded valve provides ingress into the internal dryer drum from a back side of the dryer to which the second open end of the clothes transfer apparatus connects.

3. The programmable automated clothes washer, transfer, and dryer system of claim 2, wherein the second open end of the clothes transfer apparatus connects to the one-way spring loaded valve from the back side of the dryer to push the washed clothes into the internal dryer drum.

4. The programmable automated clothes washer, transfer, and dryer system of claim 1 further comprising a programmable automated laundry pre-load cabinet comprising a plurality of cabinet shelves configured to hold multiple loads of unwashed laundry and a cabinet control unit that is communicably connected to the main system control unit and configured to control automatic release of individual shelves in the plurality of cabinet shelves for automatic release into the washing machine.

5. The programmable automated clothes washer, transfer, and dryer system of claim 4, wherein the cabinet shelves comprise automatic release doors that flap open to release each load of unwashed laundry individually and according to a programmed wash and dry cycle as controlled by the cabinet control unit.

6. A programmable automated clothes washer, transfer, and dryer system comprising:

a host computer;

a main system control unit communicably connected to the host computer;

a programmable automated clothes washing machine comprising an outlet channel, a washer control unit that is configured to control automatic operation of programmed wash cycles in connection with the main system control unit, and an internal washer drum in which a load of laundry is placed for washing during an automatic, programmed wash cycle as controlled by the washer control unit;

a programmable automated dryer comprising a dryer control unit that is configured to control automatic operation of drying cycles in connection with the main system control unit, an internal dryer drum, and a one-way spring loaded valve that provides ingress into the internal dryer drum for washed clothes to be automatically dried by the dryer as controlled by the dryer control unit;

a clothes transfer apparatus comprising a first open end that connects to the outlet channel of the programmable automated clothes washing machine and a second open that end connects to the one-way spring loaded valve of the programmable automated dryer to provide a clothes transfer path between the programmable automated clothes washing machine and the programmable automated dryer; and a programmable automated laundry pre-load cabinet comprising a plurality of cabinet shelves configured to hold multiple loads of unwashed laundry and a cabinet control unit that is communicably connected to the main system control unit and configured to control automatic release of individual shelves in the plurality of cabinet shelves for automatic release into the washing machine.

7. The programmable automated clothes washer, transfer, and dryer system of claim 6, wherein the cabinet shelves comprise automatic release doors that flap open to release each load of unwashed laundry individually and according to a programmed wash and dry cycle as controlled by the cabinet control unit.

* * * * *